US009051155B2

(12) United States Patent
Herkel et al.

(10) Patent No.: US 9,051,155 B2
(45) Date of Patent: Jun. 9, 2015

(54) ELEVATOR RESCUE SYSTEM INCLUDING COMMUNICATIONS OVER A RESCUE OPERATION SIGNAL TRANSMISSION PATH

(75) Inventors: Peter Herkel, Berlin (DE); Hans-Kilian Spielbauer, Berlin (DE); Juergen Gewinner, Berlin (DE); Matthias Hoinkis, Berlin (DE)

(73) Assignee: Otis Elevator Company, Farmington, CT (US)

( * ) Notice: Subject to any disclaimer, the term of this patent is extended or adjusted under 35 U.S.C. 154(b) by 725 days.

(21) Appl. No.: 13/377,301

(22) PCT Filed: Jul. 2, 2009

(86) PCT No.: PCT/IB2009/006156

§ 371 (c)(1),
(2), (4) Date: Dec. 9, 2011

(87) PCT Pub. No.: WO2011/001197

PCT Pub. Date: Jan. 6, 2011

(65) Prior Publication Data

US 2012/0080273 A1 Apr. 5, 2012

(51) Int. Cl.

| | |
|---|---|
| ***B66B 1/28*** | (2006.01) |
| ***B66B 5/02*** | (2006.01) |
| ***B66B 1/34*** | (2006.01) |

(52) U.S. Cl.

CPC .. *B66B 5/027* (2013.01); *B66B 1/34* (2013.01)

(58) Field of Classification Search

CPC ..... B66B 5/027; B66B 1/34

USPC ..... 187/247, 290, 293, 313, 391–393, 288

See application file for complete search history.

(56) References Cited

U.S. PATENT DOCUMENTS

| | | | | |
|---|---|---|---|---|
| 5,971,109 | A * | 10/1999 | Aulanko et al. | 187/263 |
| 6,173,814 | B1 * | 1/2001 | Herkel et al. | 187/288 |
| 6,196,355 | B1 | 3/2001 | Fargo et al. | |
| 6,269,910 | B1 * | 8/2001 | Fargo et al. | 187/287 |
| 6,364,066 | B1 | 4/2002 | Bolch et al. | |
| 6,405,834 | B1 * | 6/2002 | Chida et al. | 187/391 |
| 6,494,296 | B2 * | 12/2002 | Lindegger et al. | 187/393 |
| 6,631,790 | B2 * | 10/2003 | Mattlar et al. | 187/375 |

(Continued)

FOREIGN PATENT DOCUMENTS

EP 1864935 A1 12/2007

OTHER PUBLICATIONS

International Preliminary Report on Patentability for International application No. PCT/IB2009/006156 mailed Jan. 12, 2012.

(Continued)

*Primary Examiner* — Anthony Salata

(74) *Attorney, Agent, or Firm* — Carlson, Gaskey & Olds

(57) ABSTRACT

An elevator rescue system for moving an elevator car to a disembarkation position in a rescue operation includes a rescue device (16) coupled to a brake system (4) of an elevator, the rescue device (16) comprising a rescue power source (22), wherein the rescue device (16) is disposed near the brake system (4) of the elevator; an operation panel (26) comprising a manual rescue operation switch (28), the operation panel (26) being disposed remotely from the rescue device (16); and a rescue operation signal transmission path (32) between the rescue device (16) and the operation panel (26).

22 Claims, 2 Drawing Sheets

(56) References Cited

U.S. PATENT DOCUMENTS

Figure 1:
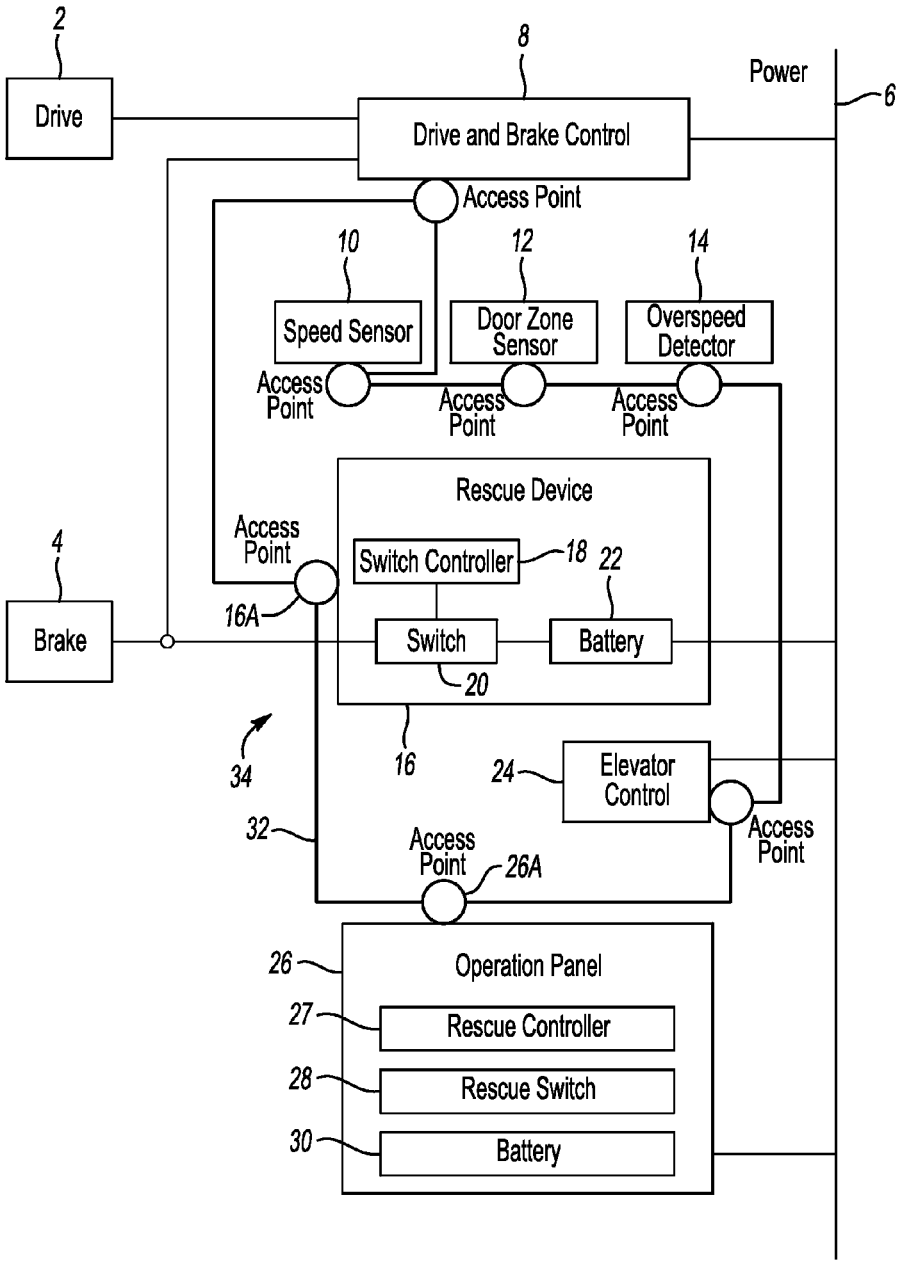

| | | | | |
|---|---|---|---|---|
| 6,847,292 | B2 * | 1/2005 | Nlabu | 340/539.1 |
| 7,434,664 | B2 * | 10/2008 | Helstrom | 187/314 |
| 7,448,473 | B2 | 11/2008 | Lindberg et al. | |
| 7,690,483 | B2 * | 4/2010 | Tegtmeier et al. | 187/394 |
| 8,316,996 | B2 * | 11/2012 | Hashimoto et al. | 187/288 |
| 2006/0021752 | A1 | 2/2006 | de St. Remey | |
| 2007/0261924 | A1 | 11/2007 | Lindberg et al. | |
| 2007/0272492 | A1 | 11/2007 | Tegtmeier et al. | |
| 2013/0270045 | A1 * | 10/2013 | Herkel et al. | 187/306 |

OTHER PUBLICATIONS

Chinese Search Report for Application No. 200980160311.1 dated Aug. 7, 2013.

International Search Report and Written Opinion of the International Searching Authority for International application No. PCT/IB2009/006156 mailed Mar. 26, 2010.

* cited by examiner

ELEVATOR RESCUE SYSTEM INCLUDING COMMUNICATIONS OVER A RESCUE OPERATION SIGNAL TRANSMISSION PATH

The invention relates to an elevator rescue system for moving an elevator car to a disembarkation position in a rescue operation.

Modern elevators comprise rescue functionality in order to move the elevator car to a landing and allow for the safe disembarkation of the passengers in an emergency situation. An emergency situation is for example the loss of power caused by an interruption of service from the public power network. In such a situation, an elevator technician is called to perform a rescue operation, which involves moving the elevator car through releasing a brake that had brought the elevator car to an abrupt halt upon the occurrence of the emergency situation. As electromagnetic brakes are commonly used in modern elevators, large amounts of electrical power are needed for releasing the brake and carrying out the rescue operation. This electrical power is usually stored in a battery dedicated for rescue purposes. As batteries used for storing substantial amounts of electrical energy are costly, large and heavy, the needed rescue functionality imposes undesirable restrictions on the design of the overall elevator system. Besides, elevator rescue operations are commonly cumbersome, because the rescue operation equipment, which comprises the rescue operation battery and brake release circuitry, is poorly accessible for the elevator technician. This leads to longer rescue times, which in turn can lead to increased electrical power requirements, as the rescue operation equipment has to be kept functioning for an extended period of time.

Accordingly, it would be beneficial to provide an elevator rescue system, which has low electrical energy requirements and is easily operable by an elevator technician.

Exemplary embodiments of the invention include an elevator rescue system for moving an elevator car to a disembarkation position in a rescue operation. The elevator rescue system comprises a rescue device coupled to a brake system of an elevator, the rescue device comprising a rescue power source, wherein the rescue device is disposed near the brake system of the elevator; an operation panel comprising a manual rescue operation switch, the operation panel being disposed remotely from the rescue device; and a rescue operation signal transmission path between the rescue device and the operation panel.

Exemplary embodiments of the invention further include a method of moving an elevator car to a disembarkation position in a rescue operation, the method comprising establishing a rescue operation signal transmission path between a rescue device and an operation panel, wherein the rescue device is coupled to a brake system of an elevator and comprises a rescue power source, with the rescue device being disposed near the brake system of the elevator, and wherein the operation panel comprises a manual rescue operation switch, the operation panel being disposed remotely from the rescue device. The method further comprises starting a rescue operation as a response to receiving a signal from the manual rescue indication switch indicating a rescue operation start command.

Embodiments of the invention are described in greater detail below with reference to the figure wherein:

FIG. 1 shows a block diagram of a portion of an elevator system, said portion comprising an elevator rescue system.

Figure 1A:
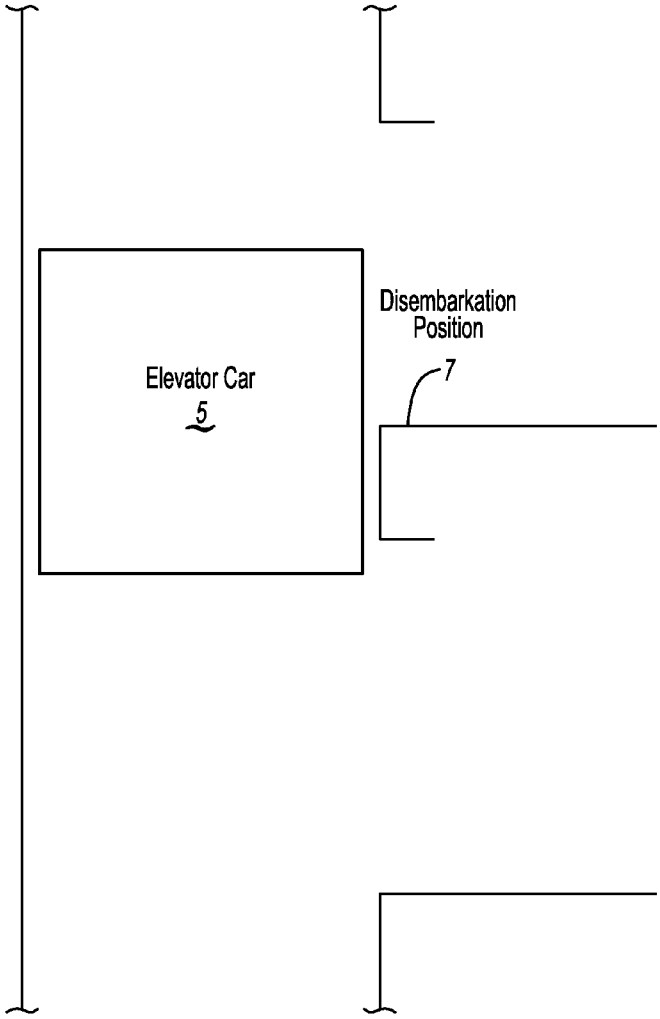

FIG. 1A schematically shows selected portions of an elevator system.

FIGS. 1 and 1A depict block diagrams of a portion of an exemplary elevator installation. Said portion comprises an exemplary embodiment of an elevator rescue system in accordance with the present invention. The elevator system comprises a drive 2 and a brake 4 for moving and stopping an elevator car 5. The elevator system may comprise the elevator car 5 and a counterweight such that the drive 2 and the brake 4 move the elevator car 5 and the counterweight simultaneously. The elevator may be a machine-roomless elevator, and the elevator car as well as the counterweight may be suspended in a two to one roping configuration. The elevator system may further be a traction elevator system, with the drive 2 comprising a traction sheave for transferring motion to one or more suspension means, such as ropes or belts. However, the present invention is applicable to a wide range of different kinds of elevator systems, such as traction elevators or winding elevators or hydraulic elevators, as well as to different kinds of suspension/roping configurations.

The elevator system further comprises a drive and brake control 8, which is coupled to drive 2 and brake 4. The drive and brake control 8 is also coupled to a power supply 6. The power supply 6 provides the elevator system with electrical power. It may be directly or indirectly coupled to the power grid. Accordingly, the power supply 6 may provide AC power having 110-230 V and 50-60 Hz, as it is commonly available from the power grid. Alternatively, a pre-conversion of the electrical power received from the grid may be carried out, and said converted power may be supplied to the elevator system by power supply 6.

The elevator system further comprises a speed sensor 10, a door zone sensor 12, and an overspeed detector 14. It also comprises a rescue device 16, which in turn comprises a switch controller 18, a switch 20, and a battery 22. The battery 22 is coupled to power supply 6 and to switch 20. The switch 20 is also coupled to brake 4 and to the switch controller 18 of the rescue device 16.

The elevator system also comprises an elevator control 24, which is coupled to the power supply 6. The elevator system also comprises an operation panel 26, which is coupled to the power supply 6 and comprises a rescue controller 27, a rescue switch 28 and a battery 30.

The drive and brake control 8, the speed sensor 10, the door zone sensor 12, the overspeed detector 14, the rescue device 16, the elevator control 24, and the operation panel 26 are connected by a communication network 34, which is a Control Area Network (CAN) bus in the exemplary embodiment of FIG. 1. For access to the communication network 34, above listed units each comprise network access points. For example, operation panel 26 comprises CAN bus access point 26A. These access points are capable of encoding/decoding data to be transmitted over the CAN bus in data packets, which are in compliance with the CAN bus standard, and to control CAN standard compliant access to the CAN bus. In the exemplary embodiment of FIG. 1, the CAN bus 34 is organized in a ring topology. Link 32, which connects the operation panel network access point 26A and the rescue device network access point 16A is an exemplary portion of that ring topology. However, the communication network may be configured in a variety of different topologies, such as a star topology or a line bus topology, as is known to a person skilled in the art. The CAN bus allows all devices of the elevator system that have CAN bus access points to exchange information in accordance with a communication protocol common to all of these entities.

It is pointed out that the CAN bus 34 may connect a wide variety of further components. Examples for these components are elevator call buttons at the individual landings, floor request buttons in the elevator car, elevator car location displays in the elevator car and at the individual landings, door closure sensors, etc. The CAN bus may also connect a plurality of elevator installations, for example a plurality of adjacent elevators, to allow for a joint elevator control, which co-ordinates the individual operations of the plurality of elevators.

It is also pointed out that electrical power for low power applications may be transmitted via the CAN bus. For example, door zone sensor 12 or overspeed detector 14 or the floor request buttons in the elevator (not shown) may be supplied with power via the CAN bus 34. However, drive 2 and brake 4 require more power for their operation than can be transmitted over the CAN bus. Consequently, drive 2 and brake 4 are not considered low power devices, whereas at least all electronic devices are considered low power applications.

The normal operation, i.e. the non-emergency situation operation, of the exemplary elevator system of FIG. 1 is described as follows. As an example, the situation is looked at when a passenger enters the elevator car at a first floor, e.g. the ground floor, and pushes the floor request button for a second floor, e.g. floor 5. Via the CAN bus, this passenger request is transmitted to elevator control 24. Elevator control 24 then provides information how brake 4 and drive 2 should be operated such that the elevator car starts moving in the direction of the requested landing. Said operation control information is transmitted to the drive and brake control 8 via CAN bus 34, where it is processed. The control information is used to determine which "amount" of power is passed on from power supply 6 to drive 2 and brake 4. Different "amounts" of power may relate to different voltages, different currents or different power supply periods. For starting the motion of the elevator, an initial power level may be supplied to drive 2 through drive and brake control 8, associated with appropriate electrical power being passed on to brake 4 in order to release the brake 4. As a consequence, the elevator car starts moving towards the requested elevator landing. The speed of the elevator car is detected by speed sensor 10. An exemplary embodiment of speed sensor 10 is an optical sensor comprising a plate with holes, said plate being attached to a drive shaft of drive 2, and a combination of a light transmitter and a light receiver, the transmitter and the receiver being positioned on respective sides of the plate and counting the number of revolutions by counting the number of times light is received through a hole of the plate. Additionally, a door zone sensor 12 may detect the relative positioning of the elevator car with respect to the individual landings. For this purpose, the elevator car and the individual landings may comprise interacting equipment, such that either the landing portions of the door zone sensor 12 can detect the car portion of the door zone sensor 12 or the car portion of the door zone sensor 12 can detect the landing portions of the door zone sensors 12, when the elevator car is in the proximity of an elevator car landing. The interaction may be an optical interaction or a magnetic interaction or any other form of interaction suitable for proximity detection.

Based on the previously transmitted control information and the information received from the speed sensor 10 and the door zone sensor 12, the elevator control 24 continuously determines updated control information and transmits said control information to drive and brake control 8 via the CAN bus 34. In this manner, a control loop is established, wherein elevator control 24 reacts to signals from speed sensor 10 and door zone sensor 12 by controlling drive and brake control 8 such that drive 2 and brake 4 effect a desired behavior of the elevator car. In above example, the elevator car is moved to the landing requested by the passenger and the car is brought to halt, when the floor of the elevator car is flush with the requested landing.

It is pointed out that the elevator control 24 may alternatively be integrated in drive and brake control 8.

A rescue operation of the elevator system is described hereinafter. The switch from normal operation mode to rescue operation mode may be triggered by various different events. For example, a loss of power from the power supply 6 may terminate the normal operation mode. As a consequence to the loss of power on power supply 6, the drive 2 and the brake 4 will not be supplied with power through the drive and brake control 8. As the brake 4 is an electromagnetic brake in the exemplary embodiment of the elevator system, the loss of power will result in the brake being applied. Additionally, the drive 2 will not be provided with electrical power, such that the elevator car and the counterweight will be stopped. In another example, one of the safety chains of the elevator system may be broken, which results in a switch to the rescue operation mode. A safety chain may be defined as a series of checks of safety relevant functionality, the series of checks being carried out periodically in order to ensure safe operation of the elevator system at any time. Should one of these checks fail, the rescue operation mode is activated. In this case, the connection between the power supply 6 and the drive 2 as well as the brake 4 through the drive and brake control 8 is interrupted such that the elevator car comes to a halt.

The decision to switch from normal operation mode to rescue operation mode may for example be taken by elevator control 24. As elevator control 24 is coupled to power supply 6, it is able to detect a loss of power. The elevator control 24 may also be responsible for performing the safety chain checks. Should the elevator control 24 decide upon a loss of power or upon a breaking of a safety chain or upon another predefined event that a switch to the rescue operation mode is to be carried out, the elevator control 24 will send out an according message via the CAN bus 34. As a reaction to this signal indicating the switch to the rescue operation mode, the elevator system, in particular the drive and brake control 8, is de-coupled from the power supply 6. The rescue operation mode is carried out using the electrical power stored in the battery 22 of the rescue device 16 and in the battery 30 of the operation panel 26. This de-coupling ensures that no undesired effects occur during the rescue operation, which are caused by power supply inconsistencies. It is pointed out that the message indicating a loss of power and/or a broken safety chain and/or another predefined event may be generated and distributed by portions of the elevator system other than the elevator control 24, as long as these portions are adapted to detect such events.

In the exemplary embodiment described in connection with FIG. 1, the rescue operation is controlled by operation panel 26. For this purpose, operation panel 26 comprises the rescue controller 27. The rescue controller 27 is supplied with electrical power by the battery 30 of the operation panel 26. After the rescue operation mode has been initiated, the rescue controller 27 of the operation panel 26 sends out a message to the nodes of the CAN bus to switch off the respective associated devices. For example, it is indicated to speed sensor 10 to not measure the speed of the elevator car until instructed otherwise. The operation panel 26 is also adapted to supply power to CAN bus 34 in order to keep the communication network functioning. Said power is supplied by battery 30. However, at this point operation panel 26 stops providing power for low power applications that are not connected to power supply 6 and receive power via the CAN bus 34 also in normal operation, such as speed sensor 10. In the particular embodiment of FIG. 1, the transmission link 32 between the rescue device 16 and the operation panel 26 is still upheld, i.e. switch controller 18 is still provided with power from battery 30 of the operation panel 26. It is thus ensured that the switch controller 18 of the rescue device 16 keeps switch 20 open such that the brake 4 stays in an applied state, which is communicated to the operation panel 26. Consequently, any sort of motion of the elevator car is prohibited until an elevator technician manually operates rescue switch 28 of the operation panel 26.

In the exemplary embodiment, the rescue switch 28 comprises three positions, a normal operation position, a rescue operation position, and a stop position. The rescue switch 28 is manually operable. As the rescue switch being in the normal operation position is required for normal operation of the elevator system, the rescue switch is still in the normal operation position when the elevator technician reaches the operation panel 26 for performing the rescue operation. For starting the process of moving the elevator car to a safe disembarkation position, the elevator technician switches the rescue switch 28 into the rescue operation position. In response to the operation of the rescue switch 28, the rescue controller 27 of the operation panel 26 sends out an activation signal via the CAN bus 34 to all devices that are involved in the actual rescue operation. In the present embodiment, the rescue device 16, the door zone sensor 12, and the overspeed detector 14 are activated and provided with power from battery 30 via the CAN bus 34 in order to be able to operate.

The elevator car is then moved to a safe disembarkation position 7 as follows. The rescue controller 27 of the operation panel 26 sends out a message to the switch controller 18 of the rescue device 16 to release the brake 4. As a response, switch controller 18 closes switch 20 such that the brake 4 is supplied with electrical power by battery 22. In case there is a sufficient weight difference between the elevator car and the counterweight, the elevator car and the counterweight will start moving. The moving direction depends on which elements—the counterweight or the elevator car including load/passengers—is heavier. For illustrative purposes, assume that the counterweight is heavier than the elevator car carrying a small load, e.g. one passenger. In this scenario, a release of the brake 4 will result in the elevator car moving upward as a consequence of the counterweight being heavier than the elevator car. For practical reasons, the landing closest to the current position of the elevator car in an upward direction is chosen as the disembarkation position.

With the brake 4 being in a released position, the elevator car keeps accelerating. The elevator car speed is monitored by overspeed detector 14. When the elevator car reaches a critical speed, the overspeed detector 14 sends a message to operation panel 26 via CAN bus 34. In the context of a rescue operation, the critical speed may be defined as a maximum elevator car speed that still allows for an abrupt stopping of the elevator car without any potentially dangerous effects for the passengers. As a response to that message from the overspeed detector 14, the rescue controller 27 of the operation panel 26 generates a message for the rescue device indicating that the brake 4 should be applied again. As a response thereto, the switch controller 18 opens switch 20 so that the power supply from battery 22 to brake 4 is interrupted. Consequently, brake 4 is applied and the elevator car is stopped. Overspeed detector 14 then indicates in a message to operation panel 26 that the speed of the elevator car has dropped below the critical speed. As a consequence, the rescue controller 27 of the operation panel 26 sends a message to the rescue device 16 over the CAN bus 34 indicating that the brake 4 should be released again. Accordingly, the elevator car will go through a cycle of being accelerated by the weight difference of elevator car and counterweight and being stopped by the application of brake 4. The speed of the elevator car follows a sawtooth-like function over time, exhibiting a substantially linear increase in velocity until the critical speed is reached and a substantially immediate stop of the elevator car in a repetitive manner.

This repetitive moving pattern is altered in this exemplary embodiment, when the elevator car approaches the safe disembarkation position. When the door zone sensor 12 detects the elevator car in the proximity of a desired floor landing for disembarkation, it sends an according message to the operation panel 26 via the CAN bus 34. As a response, the rescue controller 27 of the operation panel 26 sends a message to the rescue device 16 requesting the switch controller 18 to close switch 20/keep switch 20 open for a short interval and to open switch 20 again subsequently, such that the brake 4 is in a released state for a short interval only before being re-applied. The rescue controller 27 of the operation panel 26 then waits for an update from door zone sensor 12 indicating the current distance of the floor of the elevator car to the floor landing. Depending on that distance, the rescue controller 27 requests appropriately short intervals of elevator car motion from the rescue device, such that it is ensured that the elevator car does not overshoot the target position. The rescue algorithm carried out in the rescue controller 27 of the operation panel 26 is adapted to respond to the distance between the elevator car floor and the target disembarkation position indicated by the door zone sensor 12 such that an exact stop of the elevator car at the desired floor landing is possible. This even enables the safe disembarkation of disabled passengers being in a wheelchair.

The control of the rescue operation carried out in the rescue controller 27 of the operation panel 26 may be implemented in various different ways. Regardless of the particular algorithm, a control loop is set up, wherein the rescue controller 27 of the operation panel 26 receives messages about the state of the elevator car via the CAN bus 34, e.g. from the door zone sensor 12 and the overspeed detector 14, and sends out control messages to the rescue device 16. The particular rescue operation algorithm may also depend on the devices available during a rescue operation as well as the particular configuration of these devices. For example, the speed sensor 10 may be activated and used during the rescue operation. In such a scenario, the speed sensor 10 transmits elevator car speed information to the operation panel 26 via the CAN bus 34 on a periodic basis. As there is more information available to the rescue controller 27 of the operation panel 26 than provided by the overspeed detector 14, which only provides a binary piece of information (critical speed exceeded or not), there are more options for designing the control algorithm for the rescue operation. Particularly, an expected elevator car speed may be pre-calculated and preventive control measures may be taken by the rescue controller 27 of the operation panel 26. This is particularly useful, when switch 20 of rescue device 16 is not a mere on-off switch, but allows at least one intermediate state. Such an intermediate state, caused by a particular control signal of switch controller 18, leads to a fraction of the maximum possible power being supplied from the battery 22 to the brake 4, which in turn leads to a partial release of the brake 4. In other words, the brake 4 would be applied with a fraction of its maximum brake force. In this way, a plurality of acceleration/deceleration rates may be achieved. Providing the speed sensor 10 for the rescue operation and/or providing a switch 20 that has more than an on and an off state allows for a more elaborate control of the rescue operation and a more uniform motion of the elevator car during the rescue operation.

So far, the rescue operation has been described as a process triggered by a manual operation of the rescue switch 28 and being machine-controlled thereafter. This is insofar advantageous, as not only highly trained elevator technicians can carry out the rescue operation, but virtually everybody, for example a facility manager who is constantly present in a building. In alternative embodiments, manual supervision may be imposed on the control algorithm carried out by the rescue controller 27 of operation panel 26. For this purpose, rescue switch 28 may be placed in a stop position. An according positioning of the rescue switch 28 will lead the rescue controller 27 of the operation panel 26 to generate a message to be sent to the switch controller 18 of the rescue device 16 over the CAN bus 34 to open switch 20. In order for the elevator technician handling the rescue switch 28 to make an informed decision, operation panel 26 may be equipped with a display, which shows elevator car status data to the elevator technician. Such data may exemplarily be acquired by speed sensor 10 and/or door zone sensor 12 and/or overspeed detector 14. Such a display may be an array of LED's or an LCD screen or any other means suitable for conveying elevator car status information to a user. Accordingly, the elevator technician has the option of overruling the rescue algorithm carried out by the rescue controller 27 of the operation panel 26. As an example, this allows the elevator technician to brake the elevator car at a lower speed than the automatic control would, which may be desirable when the elevator car carries highly sensitive loads, such as a patient in a hospital.

In a particular embodiment, a continuous exchange of check messages may be established between the rescue device 16 and the operation panel 26. This continuous exchange will indicate to each of the two devices that the respectively other device is still up and working and ready to receive and process messages and/or user input. On the one hand, the switch controller 18 of the rescue device 16 is assured that any control message from the operation panel 26, either caused by a operation of the manual rescue switch 28 or caused by a message from speed sensor 10 or door zone sensor 12 or overspeed detector 14, will reach the rescue device 16 safely. On the other hand, the rescue controller 27 of the operation panel 26 is assured that the switch controller 18 of rescue device 16 will be able to react promptly to control messages sent over the CAN bus 34. These check messages may comprise a time stamp to control communication latency times introduced by the transmission of the message over the CAN bus 34. Strict time-out requirements for these check messages may ensure that the rescue operation is only carried out when timely reactions to user inputs or updated elevator car status information are guaranteed. The constant exchange of check messages may be expanded to other devices critical for the passenger safety in a rescue operation, such as the overspeed detector 14. The communication network protocol, particularly the CAN protocol, may be adapted in a way to allow for such check messages and time-out requirements. When a successful cross-check of safety-critical devices is no longer successful, the switch controller 18 of the rescue device 16 will open switch 20 in order to apply brake 4. This decision may be taken by the switch controller 18 itself or be triggered by an according message from the rescue controller 27 of the operation panel 26. When a timely exchange of check messages is effected again, the rescue operation may be continued.

In an alternative embodiment, the control of the rescue operation may be carried out by a rescue controller contained in the rescue device 16. This alternative rescue controller and the switch controller 18 may form one control module or may be formed as separate entities able to exchange information. That means that the messages from the speed sensor and/or the door zone sensor 12 and/or the overspeed detector 14 are received by rescue device 16 and that the alternative rescue controller determines control information for switch 20 based on these messages. Merely the status of the manual rescue switch 28 is transferred from operation panel to rescue device 16. Additionally, the CAN bus 34 may be powered by battery 22 of the rescue device 16 through according circuitry. Also, the operation panel 26 may be supplied with power from battery 22 via the CAN bus 34 to detect the position of the rescue switch 28 and convey that information to the rescue device 16. In such a scenario, the operation panel 26 does not need to be equipped with a battery such that all of the power used in a rescue operation may be supplied by the battery 22 of the rescue device 16 alone. Between the start of the emergency situation and the manual operation of the rescue switch 28 into a rescue operation position, the rescue device 16 may keep operation panel 26 activated and constantly exchange status check messages with operation panel 26 via CAN bus 34 in order to ensure that a manual operation of the rescue switch 28 is communicated to the rescue device 16 in a timely manner. The rescue algorithm may then be carried out by the rescue controller of the rescue device 16.

As indicated above, a release of the brake 4 may not be sufficient to put the elevator car into motion in a situation, when the elevator car including load is substantially equally heavy as the counterweight. In order to still be able to carry out the rescue operation, the battery 22 of the rescue device 16 may be connected to the drive 2 or to another drive through a second switch of the rescue device 16. This second switch may also be controlled by switch controller 18, which in turn is controlled by rescue operation control messages, for example generated by the rescue controller 27 of the operation panel 26 and transmitted via the CAN bus 34. In this way, the drive 2/the other drive and the brake 4 may work together to move the elevator car to a safe disembarkation position. An elevator car weight sensor may be used as means to indicate this weight equality situation. Also, an output from the speed sensor 10 showing an approximately zero velocity of the elevator car after the expiration of a normal time frame during which the elevator car usually starts moving after the release of the brake may be used as an indicator of this situation being present.

The positioning of the elements of the elevator system of FIG. 1 is discussed as follows. In many elevator installations, drive 2 and brake 4 are located in an upper portion of the elevator system. For example, they may be located in a machine room, which is above the elevator shaft. In a machineroom-less elevator system, the drive 2 and the brake 4 may be located in an overhead space of the elevator shaft, the overhead space being defined as the space between the top of the elevator car in its uppermost operating position and the ceiling of the elevator shaft. The drive 2 may be coupled to one or more traction sheaves by a drive shaft, with the one or more traction sheaves interacting with one or more suspension means for driving the elevator car and the counterweight, the suspension means suspending both elevator car and counterweight. The brake 4 may also be connected to said drive shaft, the brake being adapted to stop the rotation of the drive shaft, thereby braking the elevator car. In such a machineroom-less elevator system, the rescue device 16 may also be located in the overhead space of the elevator shaft. This allows for a very short distance between battery 22 and brake 4. As large amounts of power are needed to drive an electromagnetic brake, the short distance between battery 22 and brake 4 decreases the losses associated with power transmission during a rescue operation. This in turn allows for a comparably smaller battery 22, which is lighter, easier to position in the overhead space, smaller and cheaper. The operation panel 26 may be located at any position that is easily accessible by an elevator technician, who starts and oversees the rescue operation. For example, the operation panel 26 may be associated with an elevator call panel on the ground floor of a building. However, the operation panel 26 may be located behind a locked door. In another exemplary embodiment, the operation panel 26 is disposed in a facility management room located on the ground floor or in the basement of the building.

Exemplary embodiments of the invention as described above allow for carrying out a highly energy-efficient rescue operation, which an elevator technician can start and oversee from an easily accessible location. Due to the close proximity between the rescue power source and the brake system, electrical losses associated with this power transfer are kept low. This energy-saving effect is particularly substantial, because commonly used electromagnetic elevator brakes are high power devices, which require large amounts of power transferred to them every time they are activated. Moreover, in a common rescue operation the brake is continuously released and re-applied, which leads to many instances of power transfer. As the provision of the rescue operation signal transmission path between the rescue device and the operation panel allows for a remote control of the rescue operation, the positioning of the rescue device may be freely chosen in order to minimize losses associated with power transfer during a rescue operation. Accessibility of the rescue device does not have to be taken into account as a design criteria. Additionally, the operation panel, which may act as a mere remote control to the rescue device, can be implemented having small dimensions and may be positioned at virtually any location that is considered easily accessible in an emergency situation.

Regarding the feature of the rescue device being disposed near the brake system of the elevator, the term "near" may be defined in geometrical terms or in electrical terms. In geometrical terms, near may be understood as describing a distance that spans less than 50% of the floors of the elevator system, particularly less than 25% of the floors of the elevator system. In this context, all floors of the elevator system may be considered. Alternatively, only the ground floor and all floors above, i.e. all floors excluding the basement landings, may be taken into account. The brake system and the rescue device may be located on the same floor, particularly at substantially the same height. In a lateral dimension, the brake and the rescue device may not be separated by a greater distance than the largest lateral extension of the elevator shaft, e.g. the diagonal of a square elevator shaft. In electrical terms, near may be defined in terms of the electrical losses associated with the power transfer from the power source to the brake system. In this electrical context, an arrangement may be referred to as near, when the losses in the power line between the power source and the brake system are reduced by more than 50%, particularly more than 75%, as compared to the case that the power source is located on the ground floor of the building and the brake system is located at substantially the top of the elevator shaft. For a fair comparison, identical cables may be assumed when looking at the power transfer losses. For illustrating the high potential of power savings associated with such a near arrangement of power source and brake system, the following numerical example is given. An exemplary building may have 10 floors, with the cable length between the ground floor and the top of the elevator shaft being 50 m. The brake may consume 250 W. The voltage supplied by the power source may be 48 V. Accordingly, the brake current would be more than 5.2 A (due to the transfer losses). At such high current values, the reduction of the cable length has highly significant effects in terms of power savings. Analogously, the term remote may be understood as referring to a distance spanning more than 50% of the floors of the elevator system, particularly more than 75% of the floors, particularly substantially all floors of the elevator system. Again, the elevator floors taken into account may include or exclude the basement floors.

It is pointed out that the elevator rescue system is part of an elevator system. As such, the elevator rescue system may comprise devices that are not used during the normal operation of the elevator as well as device that are used during the normal operation of the elevator. In other words, the usage of a particular part of the elevator system during normal operation does not prevent this part to be part of the elevator rescue system. Also, portions of the elevator rescue system may have functionality to be used for purposes other than a rescue operation. For example, the operation panel may comprise functionality commonly attributed to a so-called maintenance panel, such as functionality to perform brake tests of the elevator system.

In a further embodiment of the invention, the rescue operation signal transmission path is part of an elevator control communication network, which comprises a plurality of nodes. Modern elevator installations comprise a communication network used for gathering information as a basis for the elevator control as well as used for distributing elevator status information, for example to be displayed to a user/passenger. Hence, the rescue operation signal transmission path being part of this elevator control communication network allows for using existing resources for effecting the communication between the operation panel and the rescue device in a rescue situation. Consequently, no communication infrastructure exclusively dedicated to the rescue operation functionality has to be included in the elevator rescue system. In this elevator control communication network, the rescue operation signal transmission path may be a direct link between two nodes. However, rescue operation messages may be routed through one or more intermediate nodes, such that the rescue operation signal transmission path comprises a plurality of sub-legs. The elevator control communication network may be a wired communication network or a wireless communication network.

The elevator control communication network may comprise a CAN bus, with the rescue operation signal transmission path being part of the CAN bus. The CAN bus standard provides a well-defined set of communication protocols. However, extensions to these protocols are possible. Consequently, the elevator control communication network comprising a CAN bus has the advantage of providing means to embed rescue operation communication into an existing and reliable framework, wherein existing resources may be used efficiently.

In another embodiment, the elevator rescue system is configured to supply power for low power applications via the elevator control communication network. This allows for using a plurality of devices, such as an overspeed detector, during a rescue operation without having to equip those devices with individual power supplies. Accordingly, the number of batteries used throughout the elevator system for rescue operation purposes can be kept low, which is advantageous in terms of reliability, maintenance and cost. Low power applications may in general be all devices that are not associated with the motion of the elevator car, i.e. all devices with the exception of the elevator drive and elevator brake, which require large amounts of power. Examples for low power devices are all electronic devices, such as control units, sensors and display devices.

In a further embodiment, the elevator rescue system is configured to de-activate nodes of the elevator control communication network which are not associated with devices involved in the rescue operation. In this way, the communication network may be reduced to those participants relevant for the rescue operation, which leads to a less power-intensive operation of the communication network during the rescue operation, which in turn allows for reduced battery sizes. Said de-activation may be done via software control messages. Alternatively, it may be done via hardware, with a central node de-connecting the links to the devices not involved in the rescue operation, when the elevator control communication network is organized in a star topology.

It is also possible that the elevator rescue system is configured to reduce the elevator control communication network to the rescue operation signal transmission path, until the manual rescue operation switch is operated. As the activation and de-activation of particular communication network nodes may be configured in an adaptive manner, further power savings may be achieved by ensuring only communication between the operation panel and the rescue device for the time period between the start of the emergency situation and the beginning of the actual rescue operation triggered by the operation of the manual rescue operation switch.

In another embodiment, the elevator rescue system is configured to transmit a status of the manual rescue operation switch over the rescue operation signal transmission path. This allows for implementing the complete control of the rescue operation in the rescue device, which leads to a very low communication burden for the rescue operation signal transmission path, as only one piece of information is to be transmitted from the operation panel to the rescue device.

In a further embodiment, the elevator rescue system further comprises an elevator car speed sensor and/or an elevator car position sensor for determining a status of the elevator car, the status comprising elevator car speed information and/or elevator car position information. The collection of elevator car status information allows for checking if the rescue control leads to the desired behavior of the elevator car. In this way, a control loop can be implemented. However, it is also possible that sufficient status information of the elevator car, such as exact position and weight, is known at the point of an emergency situation occurring and that a sequence of rescue operation commands may be generated, which lead to the elevator car reaching a safe disembarkation position without the requirement of a control loop. Although this is possible, the implementation of a control loop has the advantage that the accuracy and timing requirements of the devices used are not as strict.

The elevator rescue system may be configured to transmit the status of the elevator car over the elevator control communication network.

According to a further embodiment, the elevator rescue system comprises a controller, the controller being configured to determine a brake control signal based on the status of the elevator car and a status of the manual rescue operation switch. The controller receives feedback about the effects of its control commands and can adapt these control commands accordingly. A reliable, safe and efficient motion of the elevator car to the disembarkation position is ensured therewith. The controller may be associated with the operation panel or associated with the rescue device. Accordingly, the number of devices communicating over the elevator control communication network during the rescue operation is kept low. However, the controller may be disposed in a location other than the operation panel or the rescue device. The elevator rescue system may further be configured to operate the brake in response to the brake control signal with power supplied by the rescue power source.

In a further embodiment, the controller is configured to determine the brake control signal in an automated manner upon the manual rescue indication switch being brought in a rescue operation state. Hence, no manual applying and releasing of the brake is required. The person carrying out the rescue operation only switches the manual rescue switch once, with the following rescue operation being effected by a control algorithm, for example a control algorithm implemented in software. The controller may rely on status information about the elevator car for carrying out the rescue operation. Such status information may be provided by the elevator car speed sensor and/or the elevator car position sensor.

It is noted that the term rescue operation as used throughout the invention refers to the operation from the emergency halt of the elevator car to the arrival at the safe disembarkation position. Furthermore, the communication network may be characterized by being operable to effect an information exchange via communication protocols. Portions of the communication protocols, such as access functionality, may be implemented in the nodes of the communication networks. The term controller may not be understood as a controlling unit in a limiting way. It may be understood as a capacity of computing functionality for controlling purposes. The computing functionality may be distributed across the communication network, e.g. a number of sub-controllers, which communicate with each other, may be associated with different nodes of the communication network. The computing functionality of the nodes may be used for fully or partially carrying out the controlling algorithm as well.

In another embodiment, the elevator rescue system is configured to establish a continuous information exchange between the rescue device and the operation panel. The continuous information exchange may comprise functionality check messages for ensuring error free operation of the rescue operation signal transmission path.

The elevator rescue system may be installed in a machineroom-less elevator system.

The features and advantages described with regard to the elevator rescue system are also applicable to the method of moving an elevator car to a disembarkation position in a rescue operation. A detailed description of various further embodiments of said method is therefore omitted for brevity.

While the invention has been described with reference to exemplary embodiments, it will be understood by those skilled in the art that various changes may be made and equivalence may be substituted for elements thereof without departing from the scope of the invention. In addition, many modifications may be made to adapt a particular situation material to the teachings of the invention without departing from the essential scope of thereof. Therefore it is intended that the invention not be limited to the particular embodiments disclosed, but that the invention will include all embodiments falling within the scope of the independent claims.

The invention claimed is:

1. Elevator rescue system for moving an elevator car to a disembarkation position in a rescue operation, the elevator rescue system comprising:

a rescue device coupled to a brake system of an elevator, the rescue device comprising a rescue power source, wherein the rescue device is disposed near the brake system of the elevator;

an operation panel comprising a manual rescue operation switch, the operation panel being disposed remotely from the rescue device; and a rescue operation signal transmission path between the rescue device and the operation panel, the rescue operation signal transmission path being part of an elevator control communication network, which comprises a plurality of nodes.

2. Elevator rescue system according to claim 1, wherein the elevator control communication network comprises a CAN bus, with the rescue operation signal transmission path being part of the CAN bus.

3. Elevator rescue system according to claim 1, being configured to supply power for low power applications via the elevator control communication network.

4. Elevator rescue system according to claim 1, being configured to de-activate nodes of the elevator control communication network which are not associated with devices involved in the rescue operation.

5. Elevator rescue system according to claim 1, being configured to reduce the elevator control communication network to the rescue operation signal transmission path, until the manual rescue operation switch is operated.

6. Elevator rescue system for moving an elevator car to a disembarkation position in a rescue operation the elevator rescue system comprising:

a rescue device coupled to a brake system of an elevator, the rescue device comprising a rescue power source, wherein the rescue device is disposed near the brake system of the elevator;

an operation panel comprising a manual rescue operation switch, the operation panel being disposed remotely from the rescue device; and a rescue operation signal transmission path between the rescue device and the operation panel, the system being configured to transmit a status of the manual rescue operation switch over the rescue operation signal transmission path.

7. Elevator rescue system according to claim 1, comprising a sensor for determining a status of the elevator car, the sensor comprising at least one of an elevator car speed sensor for determining elevator car speed information or an elevator car position sensor for determining elevator car position information.

8. Elevator rescue system according to claim 7, being configured to transmit the status of the elevator car over the elevator control communication network.

9. Elevator rescue system according to claim 1, comprising a controller configured to determine a brake control signal based on a status of the elevator car and a status of the manual rescue operation switch.

10. Elevator rescue system according to claim 9, wherein the controller is associated with the operation panel or associated with the rescue device.

11. Elevator rescue system according to claim 9, being configured to operate the brake in response to the brake control signal with power supplied by the rescue power source.

12. Elevator rescue system according to claim 9, wherein the controller is configured to determine the brake control signal in an automated manner upon the manual rescue indication switch being brought in a rescue operation state.

13. Elevator rescue system according to claim 1, being configured to establish a continuous information exchange between the rescue device and the operation panel.

14. Elevator rescue system according to claim 13, wherein the continuous information exchange comprises functionality check messages for ensuring error free operation of the rescue operation signal transmission path.

15. Elevator rescue system according to claim 1, wherein the rescue power source is adapted to supply the power needed by the elevator rescue system in the rescue operation.

16. Elevator rescue system according to claim 1, wherein the operation panel comprises an operation panel power source, with the rescue power source and the operation panel power source being adapted to jointly supply the power needed by the elevator rescue system in the rescue operation.

17. A machineroom-less elevator system comprising an elevator rescue system according to claim 1.

18. Method of moving an elevator car to a disembarkation position in a rescue operation, comprising:

establishing a rescue operation signal transmission path between a rescue device and an operation panel, wherein the rescue device is coupled to a brake system of an elevator and comprises a rescue power source, with the rescue device being disposed near the brake system of the elevator, and wherein the operation panel comprises a manual rescue operation switch, the operation panel being disposed remotely from the rescue device;

starting a rescue operation as a response to receiving a signal from the manual rescue indication switch indicating a rescue operation start command; and wherein the rescue operation signal transmission path is part of an elevator control communication network, which comprises a plurality of nodes.

19. Method of moving an elevator car to a disembarkation position in a rescue operation, comprising:

establishing a rescue operation signal transmission path between a rescue device and an operation panel, wherein the rescue device is coupled to a brake system of an elevator and comprises a rescue power source, with the rescue device being disposed near the brake system of the elevator, and wherein the operation panel comprises a manual rescue operation switch, the operation panel being disposed remotely from the rescue device;

starting a rescue operation as a response to receiving a signal from the manual rescue indication switch indicating a rescue operation start command; and generating a brake control signal for carrying out the rescue operation, with the generating of the brake control signal being effected in an automated manner by a controller after receiving the signal from the manual rescue indication switch indicating the rescue operation start command.

20. Method according to claim 19, wherein the controller is coupled to the elevator control communication network.

21. Method according to claim 19, wherein the generating of the brake control signal is effected according to a rescue algorithm, the rescue algorithm being responsive to a status of an elevator car of the elevator.

22. Method according to claim 19, wherein the generating of the brake control signal is effected according to a rescue algorithm, the rescue algorithm being responsive to a distance between an elevator car position and the safe disembarkation position.

* * * * *